United States Patent [19]

Schafer

[11] Patent Number: 4,821,642

[45] Date of Patent: Apr. 18, 1989

[54] HAND OPERATED TICKET PRINTER

[76] Inventor: Christopher E. Schafer, R.R. 2, Adair, Iowa 50002

[21] Appl. No.: 150,970

[22] Filed: Feb. 1, 1988

[51] Int. Cl.[4] ..... B41K 3/12

[52] U.S. Cl. ..... 101/219; 101/329

[58] Field of Search ..... 101/219, 228, 329, 330, 101/331

[56] References Cited

U.S. PATENT DOCUMENTS

| | | | |
|---|---|---|---|
| 287,383 | 10/1883 | Kendall et al. | 101/219 |
| 326,988 | 9/1885 | Jerome | 101/219 |
| 771,900 | 10/1904 | Finch | 101/228 |
| 882,283 | 3/1908 | Wolf | 101/219 |
| 1,019,107 | 3/1912 | White | 101/219 |
| 1,541,476 | 6/1925 | Businger | 101/228 |
| 1,957,291 | 5/1934 | Rees | 101/228 |
| 2,613,598 | 10/1952 | McKay | 101/219 |
| 2,716,379 | 8/1955 | Pitt | 101/329 X |
| 3,487,776 | 1/1970 | Marozzi | 101/330 X |

FOREIGN PATENT DOCUMENTS

| | | | |
|---|---|---|---|
| 656907 | 10/1963 | Italy | 101/219 |
| 22191 | of 1892 | United Kingdom | 101/219 |

*Primary Examiner*—Clifford D. Crowder

*Attorney, Agent, or Firm*—Henderson & Sturm

[57] ABSTRACT

A hand-held printer in which tickets or the like are fed between a platen and an indicia-bearing printing wheel carried by a printing head. The platen is rotatable on a base on which the carrier is slidable vertically between an upper position in which the platen and wheel are spaced apart to receive the ticket therebetween and a down position in which the wheel presses the ticket against the platen. The printing wheel is inked by an associated inking wheel. Vertical movement of the carrier relative to the base is achieved manually by the gripping of elements located on the base and carrier. The printing head is selectively positionable crosswise of the platen to accommodate varying locations on the ticket to be printed. An adjustable ticket guide is provided to enable guiding of tickets of different dimensions.

3 Claims, 2 Drawing Sheets

HAND OPERATED TICKET PRINTER

BACKGROUND AND SUMMARY OF THE INVENTION

Various forms of printing devices are of course known in the prior art, but the present invention differs from the art primarily in the provision of a simple and compact design for printing on various types of media but especially adapted for printing indicia on tickets as addenda to printed matter already appearing on the tickets. Lottery tickets are good examples of the type of tickets for which the present printer is adapted because the printer is capable of printing on the tickets various forms of identifying indicia; e.g., the name and address of the issuer, code symbols and the like, heretofore applied by hand-stamping individual tickets.

The design features easy operation by a person using one hand to squeeze the printing head and the other hand to draw the connected series of tickets between the platen and printing head. Further features of the invention reside in the lateral adjustability of the printing head to accommodate various locations on which identifying data are to be added, together with an adjustable guide for tickets of different dimensions.

The foregoing and other features and significant objects of the invention will appear as a preferred embodiment of the invention is disclosed herein.

DETAILED DESCRIPTION OF THE PREFERRED EMBODIMENT OF THE INVENTION

Figure 1:
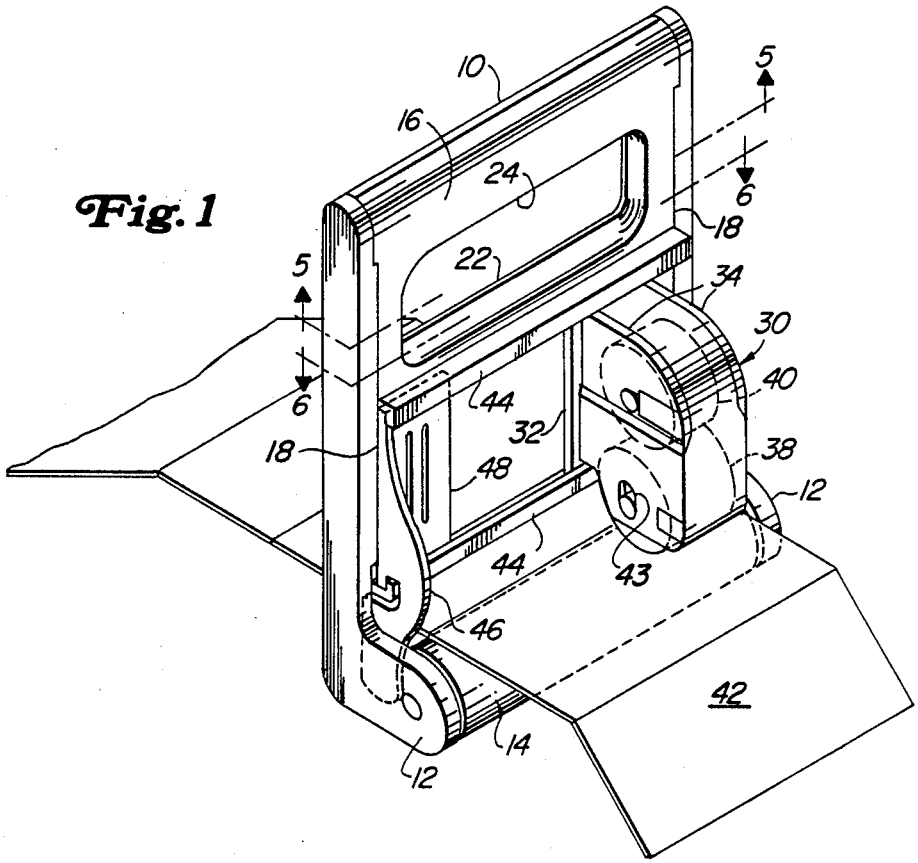
FIG. 1 is a perspective of the printer, showing representative tickets in place.
Figure 2:
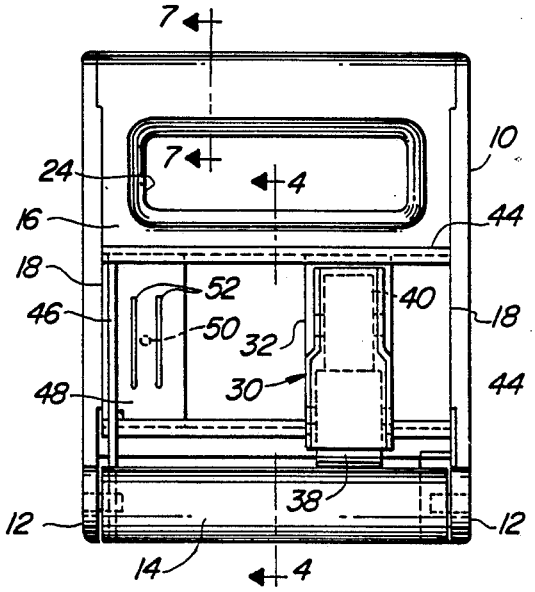
FIG. 2 is a front elevation of the printer.
Figure 5:
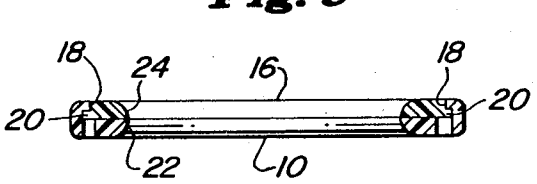
FIG. 5 is a section on the line 5—5 of FIG. 1.

Reference will be had first to FIG. 1, wherein the printer will be seen to include an upright base or frame (10) of generally rectangular shape as seen in elevation, having a top, a bottom and opposite upright sides, the bottom being recognized by the provision of a pair of outstanding supports or legs (12) between which a transverse horizontal platen (14) is carried for rotation on a horizontal axis. The materials used in the construction of the printer may be of any type possessing the characteristics of strength and durability and the supports (12) may be integral with the remainder of the base. Superimposed over one face of the base is a carried (16), also of generally rectangular shape according to a preferred embodiment of the invention, but, obviously, other shapes may be employed within the scope of the invention. The carrier is mounted on the base by means enabling limited up-and-down movement of the carrier relative to the base. In the present instance, this means includes tracks (18) rigid with and running vertically of the base at opposite sides thereof, and edge portions of the carrier, as at (20), slidably fit these tracks.

Figure 6:
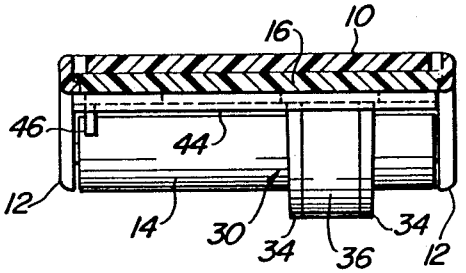
FIG. 6 is a section on the line 6—6 of FIG. 1.
Figure 4:
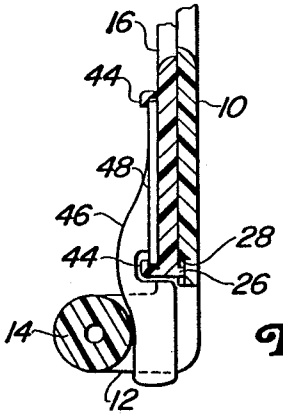
FIG. 4 is a section on the line 4—4 of FIG. 2.
Figure 7:
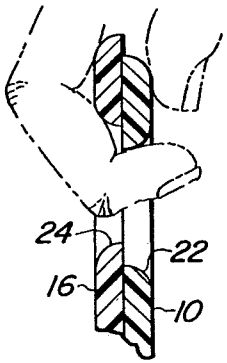
FIG. 7 is a section on the line 7—7 of FIG. 2.
Figure 3:
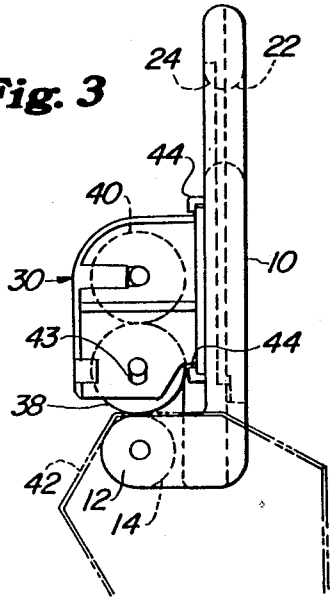
FIG. 3 is a side elevation of the printer.

As best seen in FIGS. 1, 6 and 7, provision is made for effecting up and down movement of the carrier (16) by manual force, and, to this end, the base and carrier are provided respectively with grippable portions (22) and (24) that provide an opening through which the user may insert one or more fingers and thus, by use of his fingers and thumb and/or heel of his hand, manipulate or "squeeze" the carrier between upper and lower positions. FIG. 4 shows a representative form of stop means for preventing upward escape of the carrier from the base, which means here includes a lug (26) integral with the carrier which is adapted to abut an edge portion (28) of the base. A will appear subsequently herein, the amount of permissible movement is determined according to the characteristics of the printing function.

The carrier (16) supports a printing head (30), here an element of U-section having a front (32) and laterally spaced apart, upright, fore-and-aft sidewalls (34) rigid with and projecting from the front (32). A cover (36) spans the sidewalls to provide a unitary element. The cover is also used to hold the ink wheel in place. The walls carry between them an indicia-bearing printing wheel (38) and an inking wheel (40), both rotatable on transverse horizontal axes. The inking wheel may be of any known type having an extended inking life. The printing or indicia wheel may bear any desired indicia according to the task to be performed; e.g., identification of the ticket issuer, etc. When the carrier is in its up position, the printing wheel is spaced above the platen so as to enable a series of string of tickets, as at (42), to be fed between the platen and wheel. The user then applies force via the grip portions (22) and (24) to cause relative vertical movement between the carrier and base, the former moving downwardly and the latter upwardly relative to each other to press the print wheel against the tickets as the tickets are drawn between the wheel and platen by the user's other hand. The indicia on the wheel are designed to print succeeding tickets as they pass through the wheel and platen. In order to accommodate the forces applied manually in pressing the carrier and printing head together, the wheel (38) has a limited lost-motion mounting at (43).

The flexibility of the printer as respects its ability to handle tickets of different types is enhanced by means mounting the printing head on the carrier for selective lateral positioning. This means includes a pair of transverse tracks (44) affixed to the carrier and receiving edge portions of the head. Sufficient friction is designed into the carrier-to-head relationship to retain any selected position against normal forces. As a further adjunct to handling the tickets, a ticket guide (46) has a base (48) that fits and is slidable in the tracks (44) (FIG. 4), and the bottom of that base has a projection (50) to engage the carrier to increase the friction between the guide and the carrier. The base is provided with slots (52) between which the projection is located in order to provide resiliency in the guide base for applying a downward bias to the projection.

Operation of the printer is simple. Lottery tickets are typically folded accordian or zig-zag fashion and their reverse sides are provided with blank areas for receiving stamped data according to prior practices. According to the present invention, the tickets are fed through the space between the printing wheel and the platen, manual pressure is applied to move the carrier and printing head together so that the printing wheel prints on the tickets as the tickets are drawn between the platen and printing wheel. The nature of the printing wheel and the pressure thereon assures that slippage does not occur and the "timing" of the indicia is such that each succeeding ticket is printed. Information is printed on the ticket randomly but with enough frequency to assure desired results.

The printer is easily operated and maintained and is designed for prolonged and troubled-free operation. Printing wheels of any desired type are easily adapted for use in the printing head. The adjustability of the head and ticket guide enhance the operation and utility of the printer. Features and advantages other than those pointed out herein will readily occur to those versed in the art, all without departure from the spirit and scope of the invention.

I claim:

1. A ticket printer comprising an upright rectangular frame having a transverse top, a transverse bottom and opposite upright sides, support means fixedly carried at the bottom of the frame and including a pair of support legs projecting respectively outwardly from and spaced laterally apart according to the opposite sides of the frame, a platen spanning and journalled by the legs, upright tracks respectively on the legs above the level of the platen, a carrier vertically slidably mounted in the tracks for movement up and down relative to the platen, an inking and printing head carried by the carrier and including a printing wheel cooperative with the platen and cooperative finger grip elements respectively on the carrier and frame at proximate top portions thereof for effecting sliding of the carrier and frame relative to each other between a ticket-receiving mode in which the printing wheel and platen are spaced apart to receive tickets therebetween and a ticket-printing mode in which the printing wheel and platen are pressed toward each other to print received tickets.

2. A printer according to claim 1, in which upper portions of the carrier and frame respectively have through openings and the finger grip elements are respectively cross-wise portions of the openings squeezable toward each other in the printing mode of the printer and movable away from each other in the ticket-receiving mode of the printer.

3. A ticket printer according to claim 1, in which the printing head is mounted on the carrier for selective lateral position on the carrier, and friction means is cooperative between the head and carrier for releasably retaining selected lateral positions of the head.

* * * * *